US005497996A

United States Patent [19]

Cadorniga

[11] Patent Number: 5,497,996

[45] Date of Patent: Mar. 12, 1996

[54] GOLF BALL

[75] Inventor: Lauro C. Cadorniga, Piedmont, S.C.

[73] Assignee: Dunlop Slazenger Corporation, Greenville, S.C.

[21] Appl. No.: 316,258

[22] Filed: Sep. 30, 1994

[51] Int. Cl.[6] ..... A63B 37/06; A63B 37/12; A63B 37/14

[52] U.S. Cl. ..... 273/226; 273/227; 273/230; 273/231; 273/235 R

[58] Field of Search ..... 273/226, 227, 273/220, 222, 230, 231, 232, 235 R, 219, 62

[56] References Cited

U.S. PATENT DOCUMENTS

| | | | |
|---|---|---|---|
| 2,074,803 | 3/1937 | Rickey | 273/231 |
| 2,364,955 | 12/1944 | Diddel | 273/219 X |
| 4,979,746 | 12/1990 | Gentiluomo | 273/220 |
| 5,033,749 | 7/1991 | Kakiuchi et al. | 273/227 |
| 5,338,038 | 8/1994 | Cadorniga | 273/216 |
| 5,403,010 | 4/1995 | Yabuki et al. | 273/220 |
| 5,439,227 | 8/1995 | Egashira et al. | 273/230 X |
| 5,445,387 | 8/1995 | Maruko et al. | 273/230 X |

*Primary Examiner*—George J. Marlo
*Attorney, Agent, or Firm*—Lorusso & Loud

[57] ABSTRACT

There is presented a golf ball having a core and a cover, the ball weighing 41–44.5 grams, and having a diameter of about 1.68 inches. The core is provided with a specific gravity of 1.01–1.09. The cover is provided with a specific gravity of 0.90–0.98 and a Shore D hardness of 40–65. The ball provides increased range when hit with slow to moderate club head velocity.

15 Claims, 5 Drawing Sheets

GOLF BALL

BACKGROUND OF THE INVENTION

1. Field of the Invention

This invention relates to golf balls, and is directed more particularly to a golf ball providing increased range when hit at slow to moderate club head velocities.

2. Description of the Prior Art

The United States Golf Association (USGA) approves golf balls having a maximum weight of 45.93 grams and a minimum diameter of 1.68 inches. It has been generally believed that the heavier the ball and smaller the size, the greater the range or distance performance of the ball. However, such beliefs have been based upon the play of excellent players, usually at the professional level, who have club impact rates (with the driver club) of 100 m.p.h. and greater.

There are lighter weight balls, but they are designed for short distance usage. Balls popularly known as "Cayman" balls weigh 20–35 grams and are designed to travel a short distance at any club impact rate, including 100 mph or greater. Driving range balls typically weigh 35–40 grams in the standard 1.68 inch size and do not travel nearly as far as the standard balls. Novelty balls, such as "floaters" afford an even shorter range and are not intended for regular golf match use.

While the maximum weight ball provides maximum range for players who produce club head velocities of 100 mph, or more, the average golfer is more likely to produce club head velocities (using the driver club) of about 70–95 MPH. It has been found that at the slower club head velocities, the standard heavy ball (45.93 grams) does not provide the longest range, but rather, a ball lighter than the maximum weight, but heavier than Cayman balls, driving range balls, and novelty balls, actually provides for a longer range than does the standard heavy ball.

SUMMARY OF THE INVENTION

Accordingly, an object of the invention is to provide a golf ball which affords maximum driving range when hit with a driver club at moderate club head velocities.

With the above and other objects in view, as will hereinafter appear, a feature of the present invention is the provision of a two-piece golf ball having a core and a cover, the ball weighing 41–44.5 grams, and having a diameter of about 1.68 inches. The core is provided with a specific gravity of 1.01–1.09. The cover is provided with a specific gravity of 0.90–0.98 and a Shore D hardness of 40–65. The ball provides increased range when hit with slow to moderate club head velocity.

In accordance with a further feature of the invention, the core is molded with a diameter of 1.495–1.515 inches and a weight of 31–32.5 grams.

In accordance with a still further feature of the invention, there is provided a golf ball having a coefficient of restitution of 0.725–0.732, an initial velocity of 253.6–254.3 ft./sec., a weight of 42–44.5 grams, and a diameter of about 1.68 inches. The ball exhibits further distance performance when hit at club head velocities of 80–90 mph than do heavier balls of equal diameter.

The above and other features of the invention, including various novel details of construction and combinations of parts, will now be more particularly described with reference to the accompanying drawings and pointed out in the claims. It will be understood that the particular balls embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
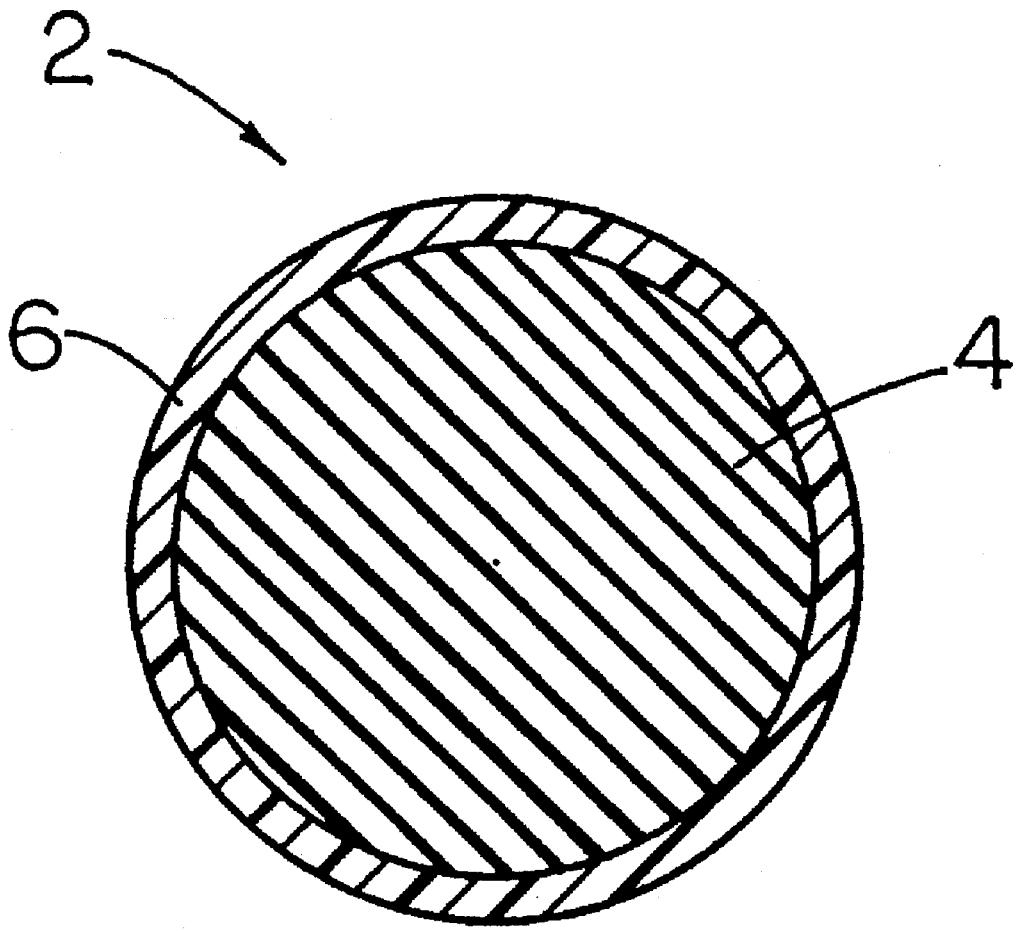
FIG. 1 is a diagrammatic centerline sectional view of one form of golf ball illustrative of an embodiment of the invention.

Referring to FIG. 1, it will be seen that the illustrative ball 2 includes a core 4 and a cover 6. The weight of the ball 2 ranges from 41 to 44.5 grams. The diameter of the ball 2 is the customary 1.68 inches. Thus, the ball 2 is of the same size as standard golf balls, but of a lighter weight than standard golf balls.

The core 4 is compounded of known chemical and rubber core materials to provide a reduced specific gravity in the range of 1.01–1.09, while maintaining a ball coefficient of restitution of less than the USGA limit of 0.735, and usually in a range of 0.725–0.732. Typically, the core materials include polybutadiene and polyisoprene rubbers, a clay filler, zinc oxide as a filler and activator, zinc diacrylate and peroxide as crosslinking agents, and zinc stearate as a processing aid and activator. By decreasing inorganic filler amounts and adding natural rubber, a maximum coefficient of restitution may be maintained without exceeding the USGA limit. The USGA prescribed coefficient of restitution limit of 0.735 equates to an initial velocity limit of 255 ft./sec., shown on the graph of FIG. 2. The core 4 is molded into a spherical configuration having a diameter of 1.495–1.515 inches.

The cover 6 is formulated, generally of zinc, sodium and magnesium ionomers, to maintain an acceptable coefficient of restitution for the ball and to have a cover specific gravity of 0.90–0.98 and a Shore D hardness of 40–65. The cover material is formulated, and a dimple pattern, dimple volume and surface area are selected, to provide ideal spin rate of the ball, to optimize flight distance performance. The preferred spin rates are:

Driver: 1800–2300 rpm 5-iron: 3000–5000 rpm

Wedge: 4000–7000 rpm.

In a preferred embodiment, there are 432 dimples with dual radii, occupying a volume of 400 $mm^3$ and a surface area of 85.1%. By "dual radii" is meant a dimple having a rounded upper edge, and a rounded lower edge leading to a substantially flat bottom. One radius is taken at the upper rounded edge and a second radius is taken at the lower rounded edge when specifying particular sizes of such dimples, as is known in the art.

The lower Shore D hardness cover, 40–65, as compared to typical prior art covers of Shore D hardness of 68–70, provides a softer cover, which, in turn, provides for a softer "feel" when hitting the ball. Usually, a softer cover exhibits an increased spin rate which generally detracts from distance performance. However, in accordance with the invention the reduction in overall weight of the ball permits a softer cover and softer "feel" while not increasing spin rate and not detracting from distance performance, as will be seen in descriptions of Examples 2 and 3, hereinbelow.

Two embodiments of the invention have been made and are described in the following examples, along with, firstly, a prior art ball.

EXAMPLE 1

A prior art ball had a core of specific gravity of 1.14, weight of 34.5 grams, and diameter of 1.510 inches. The cover of the ball was of a diameter of 1.680 inches and exhibited a Shore D hardness of 68–70. The ball weighed 45.0 grams. The prior art ball exhibited a spin rate of about 2300 rpm with a driver, about 4250 rpm with a 5-iron, and about 6,750 with a wedge. In a machine flight test (FIG. 3), a driver club head velocity of 100 mph produced an initial ball velocity of 254.3 ft./sec. (FIG. 2) and a range of 259 yards (FIG. 3); a velocity of 90 mph produced a range of 214 yards (FIG. 3); and a driver club head velocity of 80 mph produced a range of 193 yards (FIG. 3).

EXAMPLE 2

Figure 3:
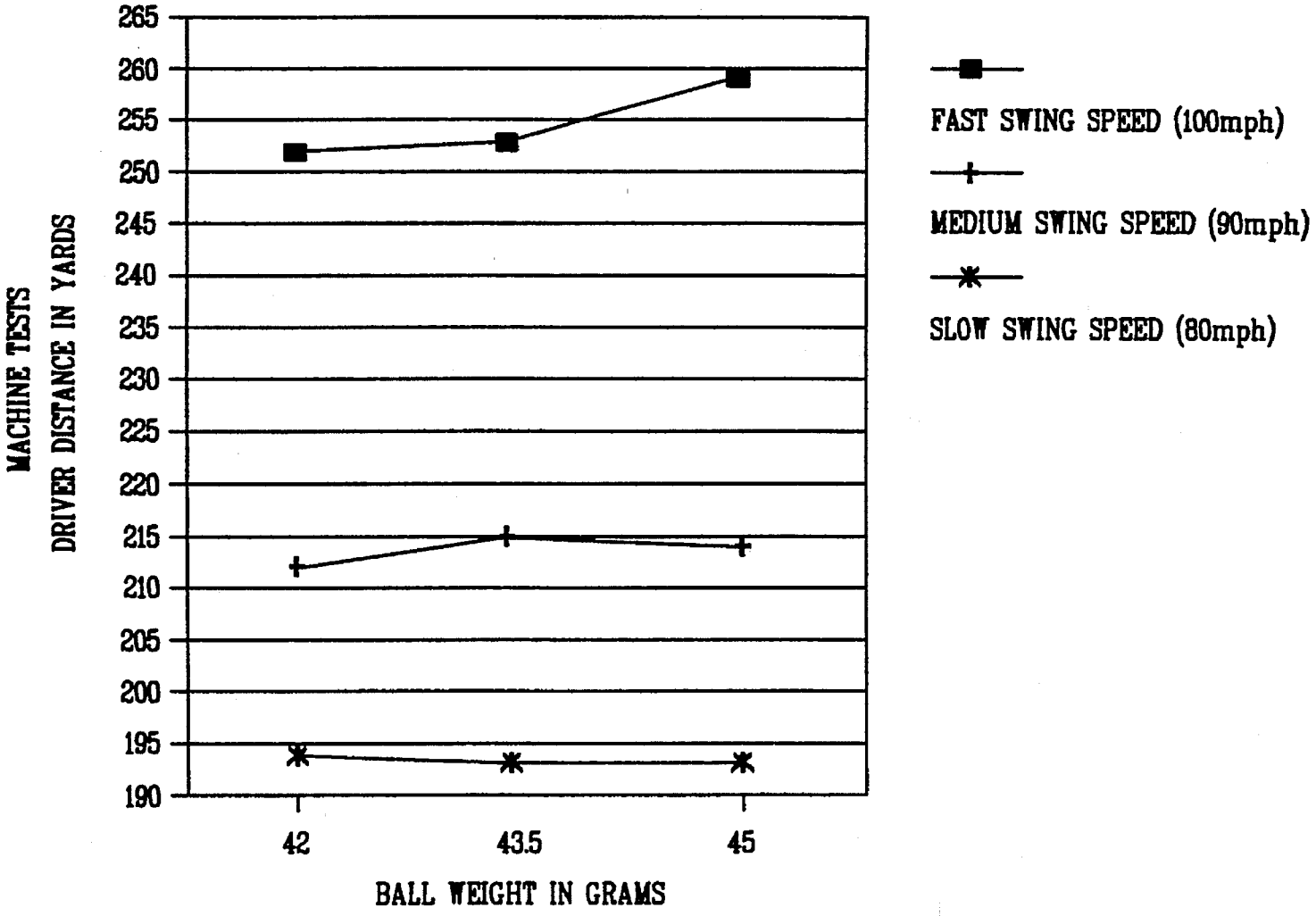
FIG. 3 is a chart showing distance in yards obtained with balls of given weights when hit with fast, medium and slow club swing speeds.
Figure 4:
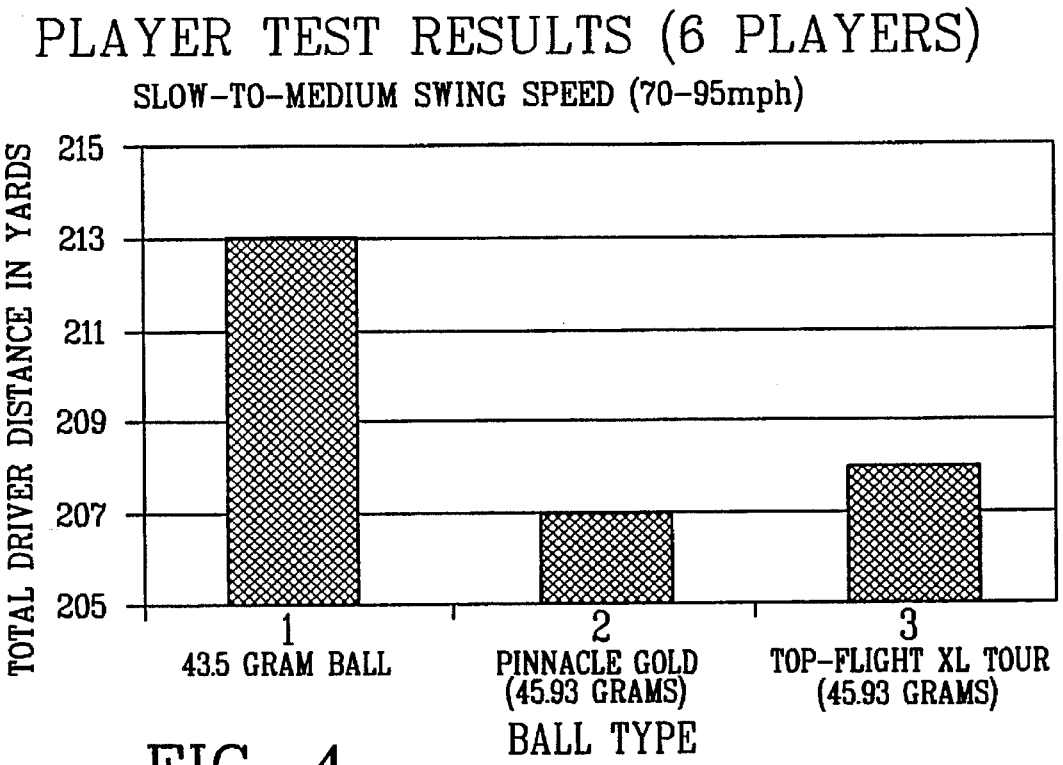
FIGS. 4 and 5 are charts illustrating distance performance comparisons between balls in accordance with the present invention and prior art balls.

A first of the inventive balls 2 had the core 4 of specific gravity of 1.07, weight of 32.5 grams, and diameter of 1.510 inches. The cover 6 was of a diameter of 1.680 inches, and exhibited a Shore D hardness of 63–65. The ball weighed 43.5 grams. The first ball 2 exhibited spin rates similar to those exhibited by the prior art ball of Example 1. In machine tests (FIG. 3), a driver club head velocity of 100 mph resulted in an initial ball velocity of 253.6 ft./sec. (FIG. 2) and a range of 253 yards (FIG. 3), a velocity of 90 mph produced a range of 215 yards (FIG. 3), and a velocity of 80 mph produced a range of 193 yards (FIG. 3). In a player driver test involving six players having slow to medium club head velocities (70–95 mph) the first ball, on average, exceeded the "Top-Flite XL Tour" ball (45.93 grams) by 5.0 yards and the "Pinnacle Gold" ball (45.93 grams) by 6.0 yards (FIG. 4).

EXAMPLE 3

Figure 5:
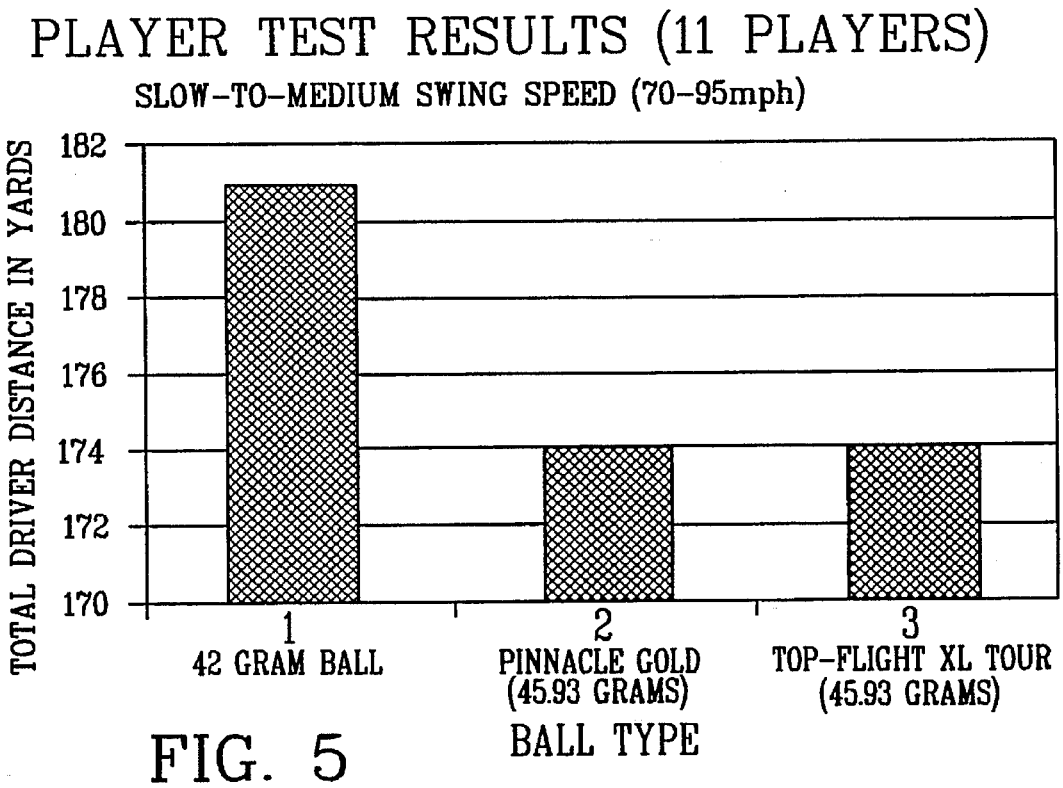

A second of the balls 2 had a core 4 of specific gravity of 1.04, weight of 31.0 grams, and diameter of 1.510 inches. The cover 6 was of a diameter of 1.680 inches, and exhibited a Shore D hardness of 63–65. The ball weighed 42.0 grams. The second ball exhibited spin rates similar to those exhibited by the prior art and first balls of Examples 1 and 2. In machine tests (FIG. 3), a driver club head velocity of 100 mph resulted in an initial ball velocity of 253.9 ft./sec. (FIG. 2) and a range of 252 yards (FIG. 3), a velocity of 90 mph produced a range of 212 yards (FIG. 3), and a velocity 80 mph produced a range of 194 yards (FIG. 3). In a player driver test involving eleven players having slow to medium club head velocities (70–95 mph) the second ball, on average, exceeded the "Top-Flite XL Tour" ball and the "Pinnacle Gold" ball by 7.0 yards (FIG. 5).

General comments of the players in Examples 2 and 3 were that the ball herein described produced "softer feel" and "good flight". The players preferred balls of examples 2 and 3 to the ball of example 1.

Figure 2:
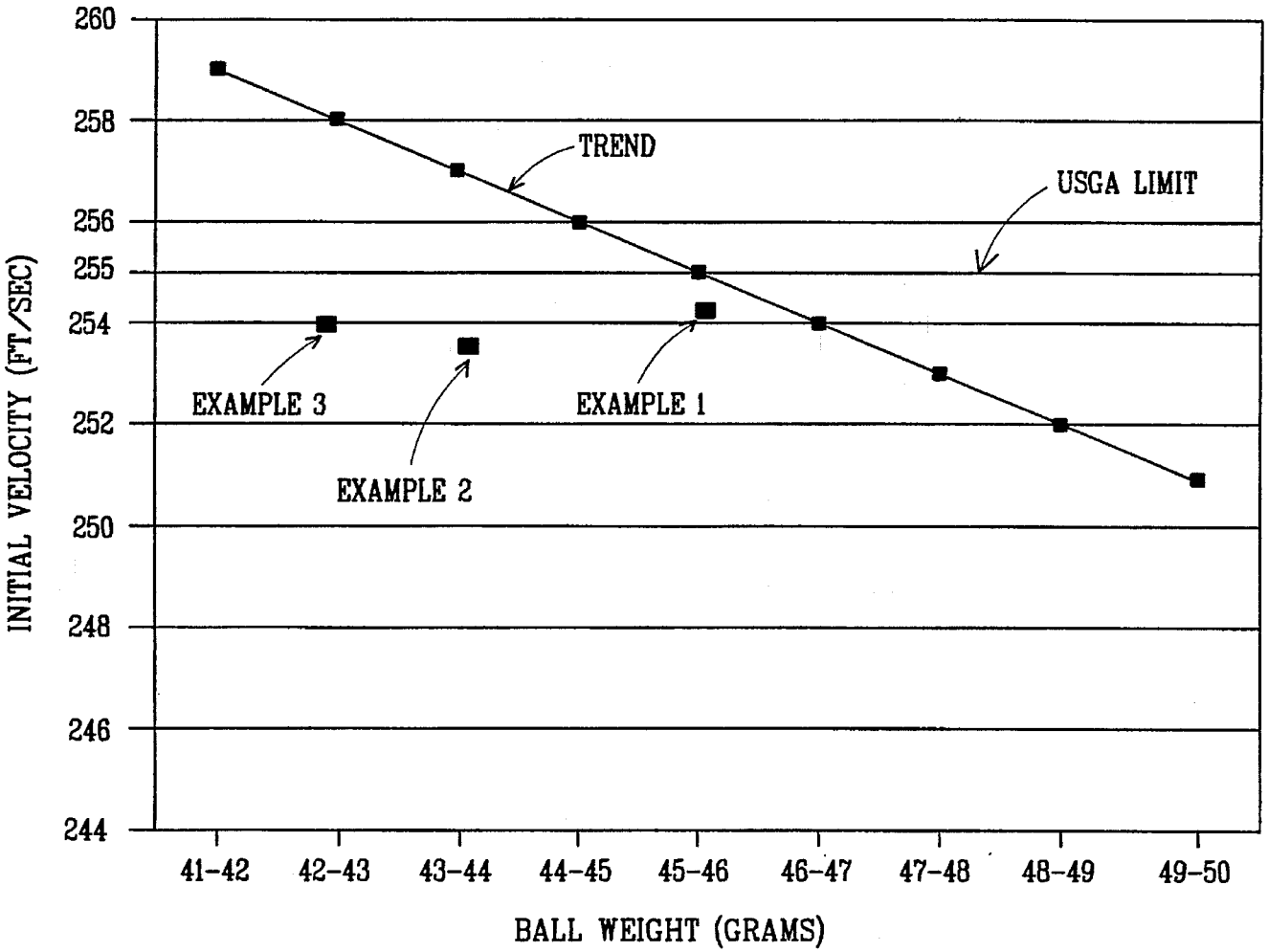
FIG. 2 is a chart showing initial velocities obtained with balls of various weights.

Referring to FIG. 2, it will be seen that, as shown by a trend line thereon, the initial velocity for a given swing speed normally increases about 1 ft./sec. as weight decreases by about one gram. Prior art balls of about 41–45 grams tend to exhibit an initial velocity which exceeds the USGA limit of 255 ft./sec. However, by adjusting the core materials and the cover blend, substantially maximum permitted initial velocity is maintained while lowering the ball weight to a 42–45 gram range, indicated by the legends "Example 2" and "Example 3" in FIG. 2, referring to the examples hereinabove.

The invention capitalizes on the concept of inertia and momentum for a given swing speed. Inertia is the concept from Newton's First Law of Motion which states that an external force is always required to start an object moving. Once the object is in motion, it tends to continue moving unless a force acts to stop the motion. Inertia is an indication of an object's mass. That is, the greater the inertia, the greater the mass. Momentum is the product of an object's mass (or inertial mass) and velocity.

Total ball distance for a given swing speed (FIG. 3) is the sum of the ball's carry and roll. Carry and roll are dependent on the capability of the club head energy to overcome the inertial properties of the ball. Slower swing speeds have less capability than faster club speeds for the same club. Maximum distance occurs at the highest ball weight for a given swing speed's capability since momentum is maximized. The ball construction in this invention demonstrates that for "slow" swing speeds (approximately 80 mph) a ball weight of approximately 42 grams yields maximum distance, as shown in FIG. 3. For "fast" swing speeds (approximately 100 mph) a ball weight of approximately 45 grams yields maximum distance. For "medium" swing speeds (approximately 90 mph) an in-between ball weight of approximately 43.5 grams yields maximum distance.

There is thus provided a ball which, when hit at 70–95 mph, and particularly at 80–90 mph club impact velocities, provides longer distance and better feel than prior art balls of 45.0–45.93 grams weight.

Figure 6:
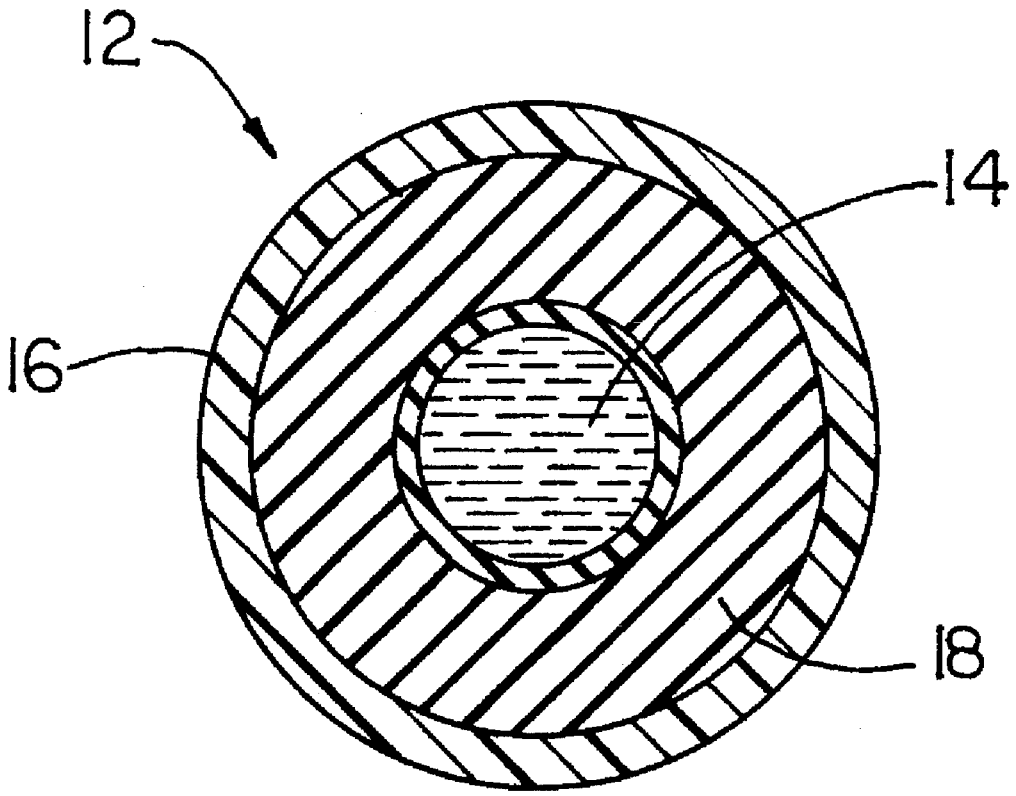
FIG. 6 is similar to FIG. 1, but illustrative of an alternative embodiment of the invention.

It is to be understood that the present invention is by no means limited to the particular construction herein disclosed and/or shown in the drawings, but also comprises any modifications or equivalents within the scope of the claims. For example, while the above description has been devoted for illustrative purposes to a two-piece ball construction, it will be apparent that the concept is readily adaptable to other constructions, as for example, a three-piece ball 12, as illustrated in FIG. 6. The three-piece ball 12, includes a center portion 14, a cover 16 and, therebetween, windings 18, typically of rubber. By reducing the diameter of the center portion 14 to 1.0–1.25 inches, and the weight of the center portion 14, which may be solid or liquid, and otherwise following the teachings hereinabove, a three-piece ball may be made lighter in total weight, but provide the attributes of "softer feel" and increased distance performance over heavier balls.

Having thus described my invention, what I claim as new and desire to secure by Letters Patent of the United States is:

1. A two-piece golf ball having a core and a cover, said ball having a weight of 41–44.5 grams; and a diameter of about 1.68 inches;

said core having a specific gravity of 1.01–1.09;

said cover having a specific gravity of 0.90–0.98; and said cover having a Shore D hardness of 40–65.

2. The golf ball in accordance with claim 1 wherein said core is molded and is provided with a diameter of 1.495–1.515 inches.

3. The golf ball in accordance with claim 1 wherein said core weighs 31–32.5 grams.

4. The golf ball in accordance with claim 3 wherein said ball exhibits a coefficient of restitution of no more than 0.735.

5. The golf ball in accordance with claim 4 wherein said coefficient of restitution is 0.725–0.732.

6. The golf ball in accordance with claim 4 wherein said ball is provided with dimples thereon occupying a volume of about 400 $mm^3$ and about 85% of the surface area of said ball.

7. The golf ball in accordance with claim 4 wherein said ball exhibits an initial ball velocity of less than 255 ft./sec.

8. The golf ball in accordance with claim 7 wherein said initial ball velocity is 253.6–254.3 ft./sec.

9. A golf ball having:

a coefficient of restitution of 0.725–0.732;

an initial velocity of 253.6–254.3 ft./sec.;

a weight of 42–43.5 grams; and a diameter of about 1.68 inches;

said ball exhibiting further distance performance when hit at club head velocities of 80–90 mph than do heavier balls having said diameter.

10. The golf ball in accordance with claim 9 wherein a core portion of said ball is provided with a diameter of 1.51 inch.

11. The golf ball in accordance with claim 10 wherein said core portion is provided with a specific gravity of 1.04–1.07.

12. The golf ball in accordance with claim 11 wherein said core weighs 31–32.5 grams.

13. The golf ball in accordance with claim 9 wherein said ball is a three-piece ball having a center portion, a windings portion, and a cover portion, said center portion having a diameter of 1.0–1.25 inches.

14. The golf ball in accordance with claim 13 wherein said center portion weighs 13.0–16.5 grams.

15. A golf ball having:

an initial velocity of 253.6–254.3;

a weight of 41–44.5 grams;

a diameter of about 1.68 inches; and a cover having a Shore D hardness of 40–65;

said ball thereby having a relatively soft cover to exhibit a soft "feel" when hit by a club head at a velocity of 70–95 mph, but exhibiting no higher spin rate than balls weighing 45.0–45.93 grams and having covers of Shore D hardness of 68–70.

* * * * *